United States Patent [19]

Tyner, III et al.

[11] Patent Number: 4,746,029

[45] Date of Patent: May 24, 1988

[54] SELF-CLOSING COOLER CURTAIN

[75] Inventors: John P. Tyner, III, Brandon; Duke A. Reddoch, Jackson, both of Miss.

[73] Assignee: Bear Creek Industries, Inc., Brandon, Miss.

[21] Appl. No.: 36,498

[22] Filed: Apr. 9, 1987

[51] Int. Cl.[4] ..... B65D 51/00

[52] U.S. Cl. ..... 220/229

[58] Field of Search ..... 160/368 R, 332, 350; 312/290, 277, 116

[56] References Cited

U.S. PATENT DOCUMENTS

| | | | |
|---|---|---|---|
| 2,213,465 | 9/1940 | Gay | 220/229 |
| 2,800,244 | 7/1957 | Witt | 220/254 |
| 3,315,402 | 4/1967 | Scott et al. | 222/229 |
| 4,037,754 | 7/1977 | Wilhelm et al. | 220/229 |

*Primary Examiner*—George T. Hall

*Attorney, Agent, or Firm*—Hubbard, Thurman, Turner & Tucker

[57] ABSTRACT

A cooler curtain for maintaining an air barrier between the opening of a storage facility and the surrounding atmosphere. A plurality of closely spaced, resilient self-closing curtain elements are relatively movable between a closed position in which the elements of a pair thereof are closely adjacent and combinatively define an air barrier to impede air movement through a portion of the opening, and an open position in which the elements in the pair are spaced further apart to provide access therebetween to the storage unit through the opening. A drop-in removable insert frame structure is suspended over the horizontal, top opening of the storage facility to position the curtain elements over the front opening and top opening forming the air barrier. The plurality of self-closing curtain elements extend horizontally between the side rails of the frame over the top opening, and depend generally vertically from the front rail of the frame over the front opening. The frame structure may be recessed within the storage unit to permit closure thereof without removal of the cooler curtain. The curtain elements are secured by a retaining member to the underside of the frame by fastening means.

21 Claims, 2 Drawing Sheets

SELF-CLOSING COOLER CURTAIN

BACKGROUND OF THE INVENTION

The present invention relates generally to curtain apparatus, and more particularly provides a uniquely configured self-closing curtain adaptable to impede air movement through the opening of a cooler or other storage facility into the surrounding atmosphere while allowing for easy manual access therethrough.

A common marketing problem associated with the maintenance of perishable food products at a constant temperature is the provision of a practical and acceptable commercial display. Freezer and cooler units displaying milk, ice cream, drinks and other perishables must be readily accessible to permit the customer to quickly and easily collect his purchase item, particularly in so-called convenience food markets having a high volume of customer traffic. Many store proprietors will accordingly leave their freezer or cooler storage units open. Unfortunately, the result is unpredictable temperature variations within the cooler units, often resulting in unacceptably high temperatures and the premature spoiling of dairy products. Likewise, the open cooler units result in a significant waste of energy as the cool air from within is dissipated into the surrounding atmosphere.

Various solutions have been employed to eliminate the above described temperature and energy loss problems. The most obvious solution is to maintain the storage units closed at all times. However, this reduces the customer's ability to quickly locate the product. There is likewise a significant inconvenience created by requiring the customer to engage in the multiple step process of opening the unit and removing the product where it is forseeable he may already be carrying a full load of other purchase items. This purpose may also be easily defeated by the careless customer who neglects to once again close the unit. Storage units have been designed which include self-closing, transparent glass doors. These coolers permit the customer to easily see the products therein without opening the door. One shortcoming with this particular design, however, is that repeated access by customers through the typically large doors tends to nonetheless result in temperature variations and energy losses, and proper door closure remains unpredictable even where magnetic seal or sping loaded doors are used. These units generally are expensive and, more importantly, do not provide a solution for incorporating the desired features into existing equipment.

It is accordingly an object of the present invention to provide a self-closing cooler curtain which eliminates or substantially minimizes the above mentioned and other problems and limitations typically associated with storage apparatus of conventional construction and operation.

SUMMARY OF THE INVENTION

The present invention provides a self-closing curtain for maintaining the temperature gradient between the interior portion of a storage facility and the surrounding atmosphere while allowing for easy manual access to the interior of the storage unit. A generally rectangular dropin frame structure cooperates with the walls of the storage unit to substantially cover the opening. A plurality of closely positioned flexible curtain elements are connected to the frame to form an air barrier over the opening. The curtain elements are easily movable between a closed position in which the elements of a pair thereof are closely adjacent and combinatively define an air barrier to impede air movement through a portion of the opening, and an open position in which the elements of the pair are spaced further apart to provide access to the storage unit through the opening. The resilient curtain elements automatically return to their closely spaced, closed position to maintain the desired air barrier.

In a preferred embodiment of the cooler curtain of the present invention the frame is generally rectangular and includes a front rail, back rail and side rails and is suspended over a top opening of the unit by bracket members connected to the side rails. A duality of closely spaced curtain elements extend between the side rails over the top opening to form a horizontal air barrier. The curtain elements may be temporarily separated along their longitudinal margin to permit access to the storage unit. A plurality of additional curtain elements are vertically suspended from the front rail of the frame across the front opening of the storage unit forming an additional portion of the air barrier. Easy manual access to the storage unit is available along any one of the vertical margins formed between the depending curtain elements which may be easily separated into an open position. As with the horizontally disposed curtain elements, the vertical curtain elements are resilient and naturally return to a closed position to maintain the air barrier. The self-closing curtain elements are preferably formed of a resilient plastic material and are extremely durable.

The curtain elements are secured to the frame structure by threaded fastening means. A retaining member supports each curtain element along the underside of the frame substantially immobilizing the element at its distal end to enhance the self-closing qualities previously described. The fastening means extends through the retaining member and the curtain element is compressed therebetween.

The cooler curtain of the present invention provides several distinct improvements to storage units of conventional construction. First, its simple construction renders it easy and relatively inexpensive to manufacture. A cooler curtain may be conformed to the particular dimensions of existing freezers, coolers or other storage units thus eliminating their need for replacement with new and more expensive equipment. Additionally, the cooler curtain permits facilitated access to the interior portion of the unit over more expensive apparatus of conventional design. Storage units having large glass doors certainly are inconvenient to open, and the undesirable temperature fluctuations are aggravated by frequent customer access to the interior storage area. According to a feature of the invention, manual access between the curtain elements results in a relatively small opening for removal of items from the interior portion of the storage unit thus maintaining a substantial air barrier even during access. Likewise, upon immediate withdrawal from the opening the curtain elements self-close to re-establish the air barrier.

In accordance with another aspect of the invention, the frame structure of the cooler curtain may be recessed within the storage unit by mounting the brackets along the top surface of the frame. The doors of the storage unit may then be shut without requiring removal of the cooler curtain. The cooler curtain may also be easily temporarily removed for filling of the storage unit.

In an alternative embodiment of the cooler curtain the horzintally disposed curtain elements covering the top opening of the unit may be transversely disposed and extend in series from the back rail of the frame to the front rail. This design permits the horizontal curtain elements and vertically depending curtain elements to be contiguously formed of a single piece of plastic or other material.

DETAILED DESCRIPTION

Figure 1:
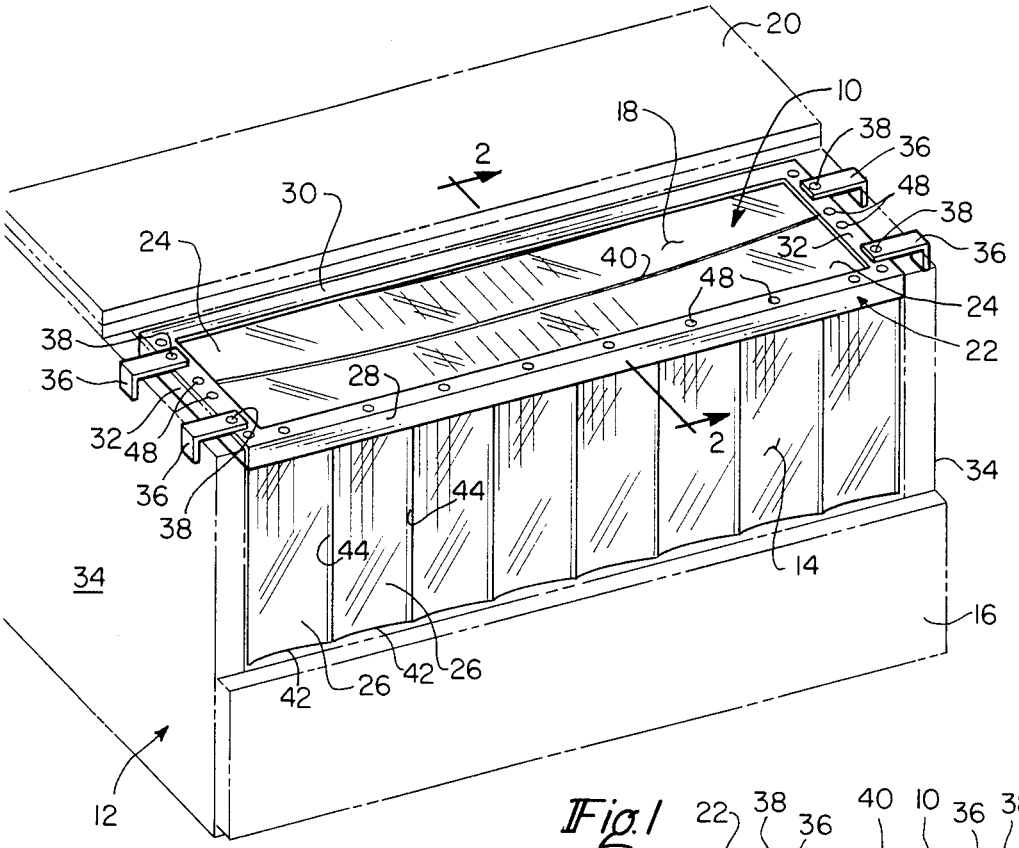
FIG. 1 is a perspective view of a self-closing cooler curtain which embodies principals of the present invention and is utilized to provide an easily accessible air barrier between the surrounding atmosphere and opening of the storage unit illustrated in phantom in FIG. 1.

Perspectively illustrated in FIG. 1 is a self-closing cooler curtain 10 which embodies principals of the present invention and is removably positioned over open storage unit 12 for providing an air barrier between the interior portion thereof and the surrounding atmosphere. Cooler curtain 10 is particularly well adapted for use in conjunction with coolers or refrigeration devices such as storage unit 12 having a front opening 14 accessible through front drop lid 16 and a generally horizontal top opening 18 which may be covered by top drop lid 20.

Figure 2:
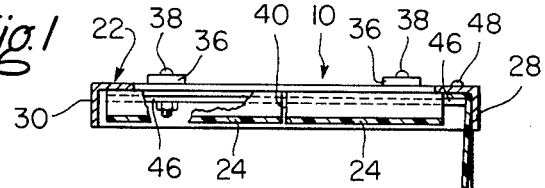
FIG. 2 is an enlarged scale cross-sectional view through the cooler curtain apparatus, taken along line 2—2 of FIG. 1.
Figure 3:
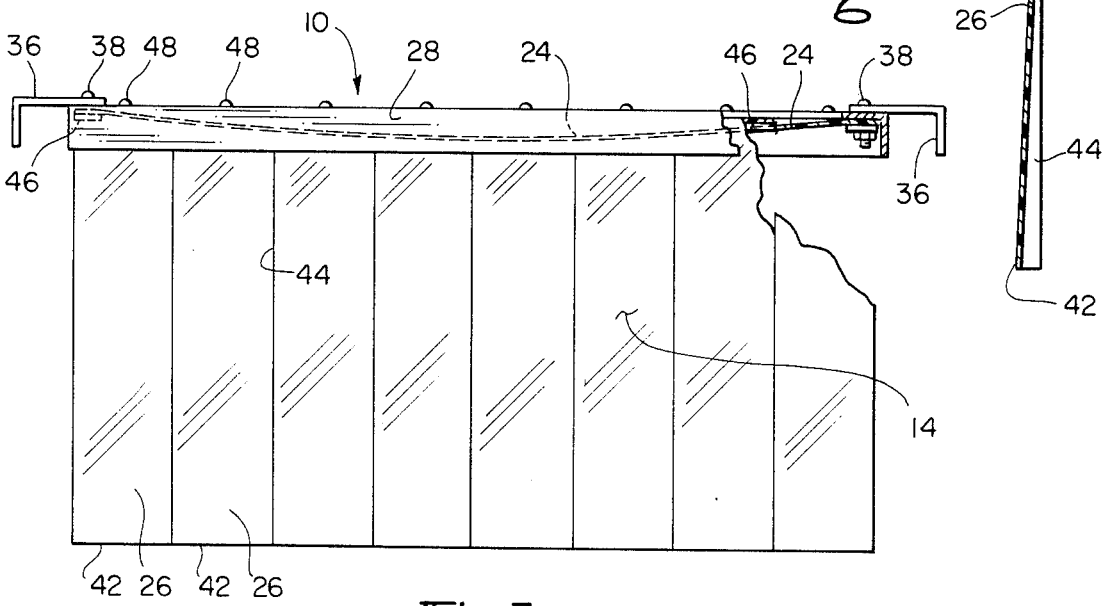
FIG. 3 is an enlarged scale partially broken away front view of the cooler curtain showing the curtain elements extending across the front opening to form an air barrier and further showing connection of the bracket means to the frame.

Referring now to FIGS. 1-3, the cooler curtain 10 comprises a generally rectangular frame 22 which supports a plurality of curtain elements 24 and 26. Frame 22 includes front rail 28, rear rail 30 and side rail 32 to form a generally rectangular structure of suitable size and dimension to closely nest between walls 34 and the base of top drop lid 20 thereby covering top opening 18. Suitable bracket members 36 are secured by suitable threaded fasteners 38 to the top portion of side rails 32. The weight of frame 22 is supported by bracket members 36 on the top portion of walls 34 to secure the cooler curtain 10 in place. Frame 22 is slightly recessed within the storage unit 12 and aligned in the same plane with the top of walls 34 and the plane formed by the front of walls 34 so that front drop lid 16 and top drop lid 20 may be closed while cooler curtain 10 is in place. This eliminates the need to remove cooler curtain 10 each time the unit 12 is closed. Frame 10 may be quickly and easily inserted over storage unit 12 or removed therefrom as required to fill the storage unit 12. Curtain 10 may be easily removed or inserted over unit 12 without the use of tools in this manner, or alternatively may be anchored by suitable fastening means to unit 12. It is contemplated that in alternative embodiments, frame 22 may be secured to storage 12 by hinges, bolts or other means. Frame 22 is preferably constructed of aluminum, steel or suitably rigid plastic.

Figure 4:
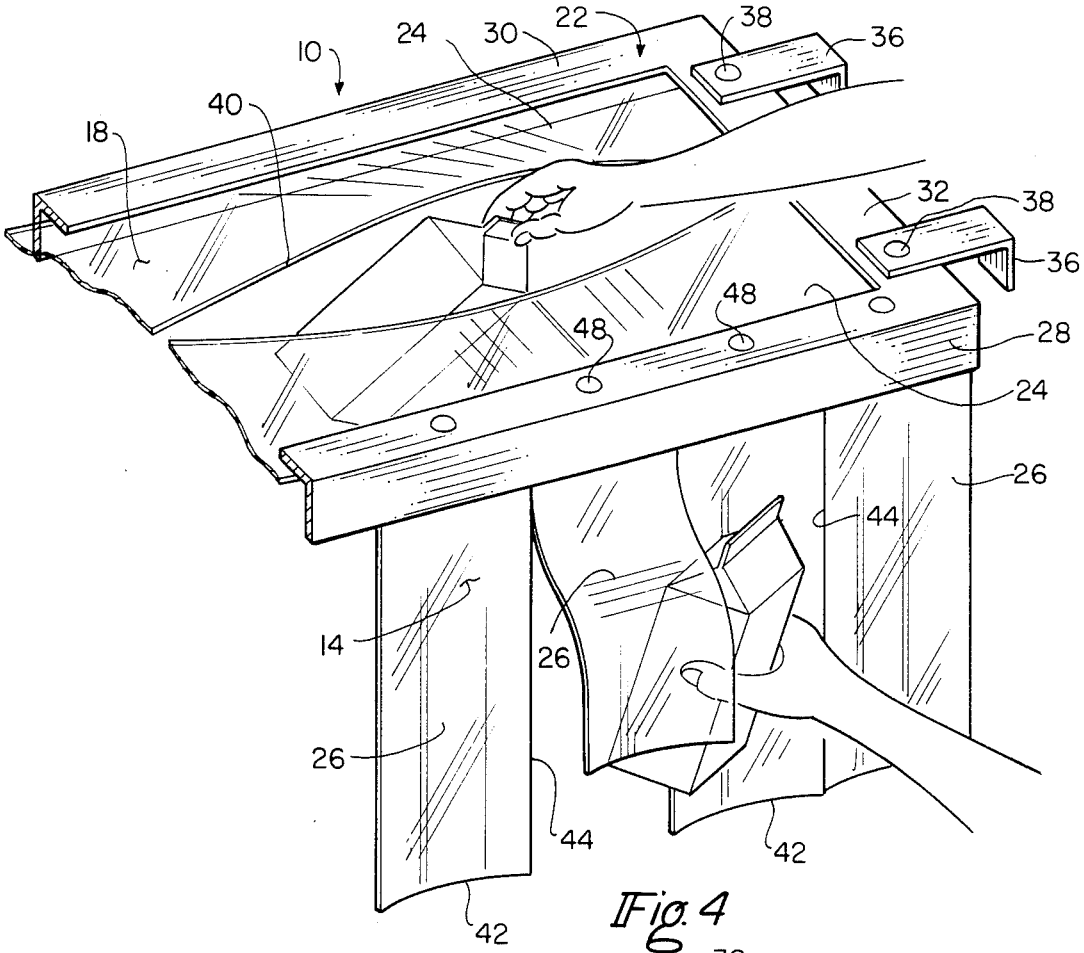
FIG. 4 is an enlarged perspective section view of the cooler curtain showing the curtain elements in an open position spaced apart to provide access therebetween.
Figure 5:
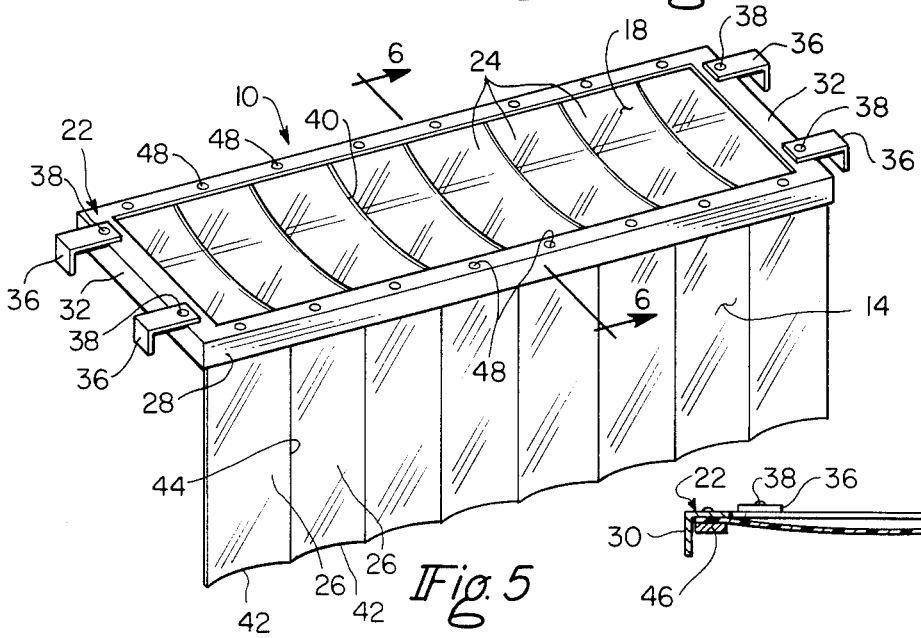
FIG. 5 is a perspective view of the cooler curtain showing an alternative transverse arrangement of the horizontal curtain elements.

Curtain elements 24 and 26 are preferably constructed of a transparent flexible material several inches in width. When in place, curtain elements 24 and 26 create an essentially uniform wall or air barrier covering front opening 14 and top opening 18. The principals of the invention as discussed herein may also be applied to form a suitable air barrier over any type or shape of opening. In their closed position, curtain elements 24 and 26 serve to maintain the temperature gradient between the interior portion of the storage unit and the surrounding atmosphere. While in this particular application that storage unit 12 is used for refrigeration of food products, it is also contemplated that cooler curtain 10 may be used to maintain the interior portion of unit 12 at significantly higher than room temperature for heating or food warming applications. Longitudinally disposed curtain elements 24 are closely spaced along their margin 40 and secured in a manner subsequently described at the distal ends thereof to side rails 32. As seen in FIG. 4, elements 24 may be separable at any particular point along margin 40 to permit manual access therethrough. The separation is sufficient at the access point to permit objects such as milk containers or the like to pass therethrough. The separation is also sufficiently localized to maintain substantial closure over the remaining portions of the opening 18. Once the objects are removed, curtain elements 24 return due to their resilient nature or by the force of gravity to their closed position forming a generally uniform thermal barrier. While it is shown in the preferred embodiment that two curtain elements are disposed in the horizontal plane across frame 22 to cover top opening 18, so as to provide a single margin 40 for manual access therethrough, any number of desired curtain elements 24 may be contemplated. Likewise, as seen in FIG. 5, curtain elements 24 may be secured between front rail 28 and rear rail 30. The arrangement of curtain elements 24 in FIG. 5 also contemplates that curtain elements 24 and 26 may be contiguous.

Curtain elements 26 depend vertically against the force of gravity from front rail 28 to substantially cover front opening 14. The lower ends 42 of curtain elements 26 may be adjusted or cut to the appropriate length to meet with the base of front drop lid 16. Access to the interior portion of storage unit 12 through front opening 14 is easily available along margins 44 between curtain elements 26. After curtain elements 26 are separated for access therethrough as shown in FIG. 4, they self close to provide the essentially uniform air barrier as previously described. In alternative embodiments, curtain elements 26 may be otherwise secured at their lower distal ends to a frame structure or the storage unit 12 itself. It is likewise contemplated that curtain elements 26 and 24 may be made to self-close by some form of spring mechanism impinging along the longitudinal axis of each element to align the elements in a plane.

Figure 6:
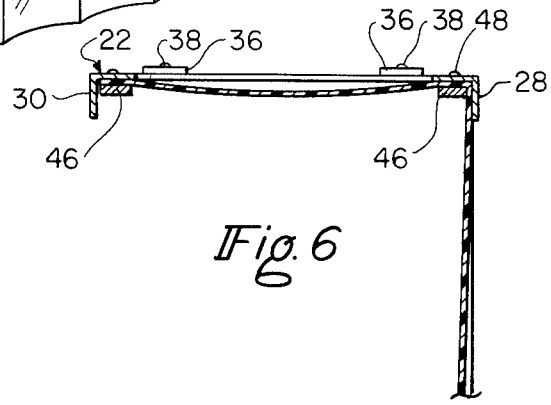
FIG. 6 is an enlarged partially broken away cross-sectional view taken along line 6—6 of FIG. 5.

Curtain elements 24 and 26 are secured to the underside of frame 22 by any suitable form of fastening means. As shown clearly in FIGS. 2, 4 and 6, the rail members of frame 22 are generally L-shaped in cross-section. The distal ends of curtain elements 24 and 26 are compressed by retaining members 46 against the underside of side rails 32 and front rail 28, and in an alternative embodiment of FIG. 5, rear rail 30. Threaded fasteners, rivots or other suitable bolt means 48 secure retaining member 46 to the underside of the rails of frame 22 with the distal ends of curtain elements 24 and 26 nested therebetween. Curtain elements 24 and 26 may be easily removed for replacement. It is also contemplated that retaining members 46 may be eliminated altogether, and curtain elements 24 and 26 be retained by suitable fasteners 48 only.

It can be seen from the foregoing that the present invention provides a cooler curtain which is of a simple, reliable and relatively inexpensive construction and is readily adaptable to a wide variety of thermal gradient or air barrier applications. Due to the unique cooperation between the self-closing curtain elements, an effective air barrier may be maintained while still permitting easy manual access to the interior portion of the storage unit at the margins therebetween. The transparent plastic strips which form the curtain elements allow for visual perception of the interior contents of the storage unit. It is contemplated that the cooler curtain may be used as a drop-in accessory in older, relatively inexpensive cooler units to provide a more reliable cooling environment therein while simultaneously eliminating energy waste through unwanted heat exchange. While in place, the cooler curtain is recessed within the storage unit to permit closure of the insulating lids. Moreover, the cooler curtain apparatus may be easily removed for filling of the unit.

The foregoing detailed description is to be clearly understood as being given by way of illustration and example only, the spirit and scope of the present invention being limited solely by the appended claims.

What is claimed is:

1. Article storage apparatus comprising:
wall means defining a housing having an opening providing access to the interior of said housing; and
a plurality of flexible self-closing curtain elements extending across said opening, adjacent pairs of said elements being relatively movable between a closed position in which the elements of the pair thereof are closely adjacent and combinatively define an air barrier to impede air movement through a portion of said opening, and an open position in which said elements in the pair thereof are spaced further apart to provide access therebetween to said interior of said housing through said opening.

2. The apparatus according to claim 1 wherein:
said opening is generally vertically disposed and said curtain elements are secured to said wall means and extend generally vertically across said opening.

3. The apparatus according to claim 1 wherein:
said opening is generally horizontally disposed and said curtain elements are secured to said wall means and extend generally vertically across said opening.

4. The apparatus according to claim 1 further comprising:
a frame means for supporting said curtain elements over said opening.

5. The apparatus according to claim 4 wherein:
said curtain elements are secured to said frame means by retaining plates.

6. The apparatus according to claim 4 wherein:
said opening includes an upper, generally horizontal top portion and a lower, generally vertical front portion, said curtain elements extending generally horizontally across said top portion and generally downwardly from said frame means across said front portion.

7. The apparatus according to claim 4 wherein:
said frame means includes mounting brackets for removably securing said frame means to said article storage apparatus.

8. Apparatus for providing a thermal barrier between the opening of a storage unit and the surrounding atmosphere, comprising:
a drop-in removable insert frame for placement over said opening;
a plurality of self-closing curtain elements attached to said frame for substantially covering said opening, adjacent pairs of said elements being relatively movable between a closed position in which the elements of the pair thereof are closely adjacent and combinatively define an air barrier to impede air movement through a portion of said opening, and an open position in which said elements in the pair thereof are spaced further apart to provide access therebetween to said storage unit through said opening.

9. The apparatus according to claim 8 wherein:
said opening includes a generally horizontal top portion and generally vertical front portion, said frame member being insertable over said top portion such that said curtain elements extend generally horizontally over said top portion and depend downwardly over said front portion.

10. The apparatus according to claim 8 wherein:
said frame includes bracket means for support of said apparatus by the walls of said storage unit.

11. The apparatus according to claim 8 wherein:
said frame is recessed within said opening to permit closure of said storage unit without removal of said apparatus.

12. The apparatus according to claim 8 wherein:
said curtain elements are anchored by fasteners between retaining members and said frame.

13. The apparatus according to claim 8 wherein:
each curtain element includes a generally horizontal portion and a generally vertical portion separated by a front rail of said frame.

14. The apparatus according to claim 9 wherein:
said curtain elements extend longitudinally over said top portion.

15. The apparatus according to claim 8 wherein:
said curtain elements are constructed of substantially transparent plastic.

16. Apparatus for providing a thermal barrier between the opening of a storage unit and the surrounding atmosphere, comprising:
a drop-in removable insert frame for placement over the top portion of said opening having a front rail, a back rail and side rails;
a plurality of self-closing curtain elements extending between said side rails to cover said top portion of said opening and further extending generally downwardly from said front rail against the force of gravity to cover the front portion of said opening, adjacent pairs of said elements being relatively movable between a closed position in which the elements of the pair thereof are closely adjacent and combinatively define an air barrier to impede air movement through a portion of said opening, and an open position in which said elements in the pair thereof are spaced further apart to provide access therebetween to said storage unit through said opening.

17. The apparatus according to claim 16 wherein:

said frame may be removably suspended over said top portion by bracket means connected to said side rails.

18. The apparatus according to claim 16 wherein:

said frame is recessed within said opening to permit closure of said storage unit without removal of said apparatus.

19. The apparatus according to claim 16 wherein:

said curtain elements are secured to said back rail and said front rail by retaining brackets.

20. The apparatus according to claim 16 wherein:

said curtain elements are constructed of substantially transparent plastic.

21. The apparatus according to claim 16 wherein:

said curtain elements extend between said back rail and said front rail to cover said top portion.

* * * * *